United States Patent [19]

Otto

[11] Patent Number: 4,866,890

[45] Date of Patent: Sep. 19, 1989

[54] COVER MEMBER FOR RAIN GUTTERS

[76] Inventor: Edgar H. Otto, 45 Hillcrest Dr., Pinehurst, N.C. 28374

[21] Appl. No.: 270,419

[22] Filed: Nov. 9, 1988

Related U.S. Application Data

[63] Continuation-in-part of Ser. No. 204,534, Jun. 9, 1988, abandoned.

[51] Int. Cl.[4] ..... E04D 13/00

[52] U.S. Cl. ..... 52/12; 210/474

[58] Field of Search ..... 52/11, 12; 210/474

[56] References Cited

U.S. PATENT DOCUMENTS

| | | | |
|---|---|---|---|
| 546,042 | 9/1885 | Van Horn | 52/12 |
| 1,597,503 | 8/1924 | Andrews | 52/12 |
| 2,284,440 | 5/1942 | Morrissey | 52/12 |
| 3,053,393 | 9/1962 | McLean | 52/12 X |
| 3,266,411 | 8/1966 | Oakley | 210/474 X |
| 3,950,951 | 4/1976 | Zukauskas | 61/15 |
| 4,590,716 | 5/1986 | Smith | 52/12 |
| 4,604,837 | 8/1986 | Beam | 52/12 |
| 4,745,710 | 5/1988 | Davis | 52/12 |

FOREIGN PATENT DOCUMENTS 203670 12/1986 European Pat. Off. ..... 52/11

OTHER PUBLICATIONS

Brookstone, no date, No. 11735 Aluminum Gutter Covers, 2 pp.

*Primary Examiner*—Henry E. Raduazo

[57] ABSTRACT

A cover member for mounting on a conventional rain gutter on a building structure, consisting of a one piece thin, longitudinal shield to be inserted under the shingles of the roof and having a serrated outer edge which is bent downward a short distance back from its edge so that it can rest on the flat portion of the inner wall at the top of the gutter's outside edge to fit snugly against the inside of the top lip of the gutter, the serrations providing small openings in front of this top lip of the gutter through which water from the roof can run into the gutter and exclude pine straw or leaves from entering the gutter.

1 Claim, 1 Drawing Sheet

COVER MEMBER FOR RAIN GUTTERS

FIELD OF THE INVENTION

This invention relates to building structure rain gutter protectors intended to direct water runoff from the roof into such gutters while preventing pine straw, leaves and other debris from entering the gutter and thus clogging the downspouts.

DESCRIPTION OF THE PRIOR ART

In the past, various solutions have been proposed. For instance: (a) screen-like gutter inserts to cover the top of the gutter eventually collect pine straw and needles in their mesh, making it very difficult to clear, thereby clogging and defeating the purpose of the gutters.

(b) Various deflector members have been proposed with the provision of some form of cover arched above the collection trough of the gutter system with a curved portion extending downwardly and reversely from the cover theoretically to cause water runoff to follow the contour of the cover and its arched portion into the trough area under the effect of surface tension, while the debris fails to cling to the cover contour. These designs fail to catch much of the water with heavy rain storms.

(c) All of these past attempts have a common deficiency. They are too expensive to be commercially successful, since most homeowners are reluctant to spend much on gutters, and would rather go without gutters if they or the guards are too expensive.

SUMMARY OF THE INVENTION

In contrast, the present invention provides a simple, one-piece low cost cover member for original or retrofit use with conventional gutter structures, being invisible from the ground, and easily installed without the need of any tools. This simple cover guard is uniquely effective in preventing the entry of pine straw as well as leaves and other debris from entering the gutter. It will catch all the water in heavy rain storms. No separate fasteners, special mounting clips or attachment hinges are required.

DESCRIPTION OF THE PREFERRED EMBODIMENT

Figure 1:
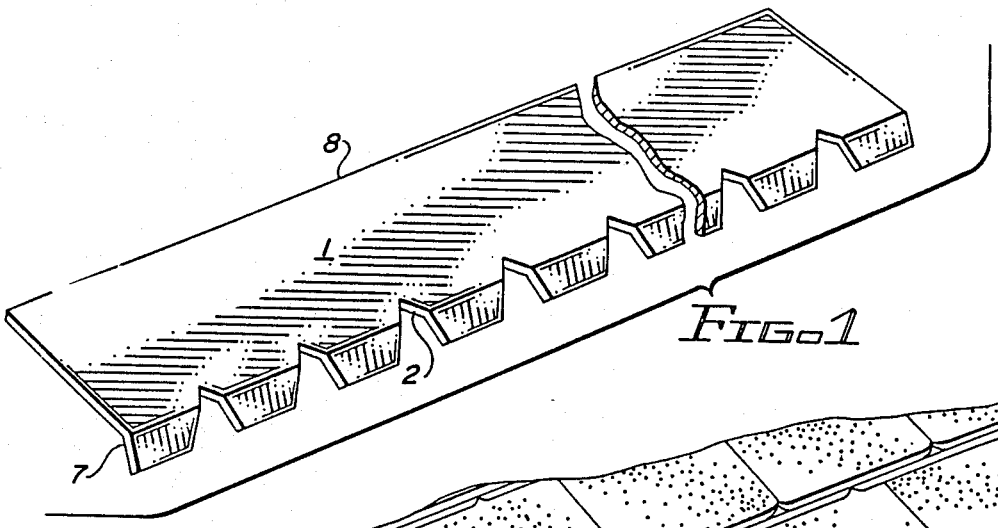
FIG. 1 is a perspective view of the single piece gutter guard.

FIG. 1 Embodies the invention in its entirety. This guard is a thin, longitudinal strip 1 with one flat straight side 8, and with serrations or notches 2 as shown cut along the opposite side which is bent sharply downward 7 at a short distance back from the edge. This notched edge is fitted snugly against the outer top edge of the gutter to provide openings for water to enter the gutter while excluding pine straw, leaves and other debris.

Figure 2:
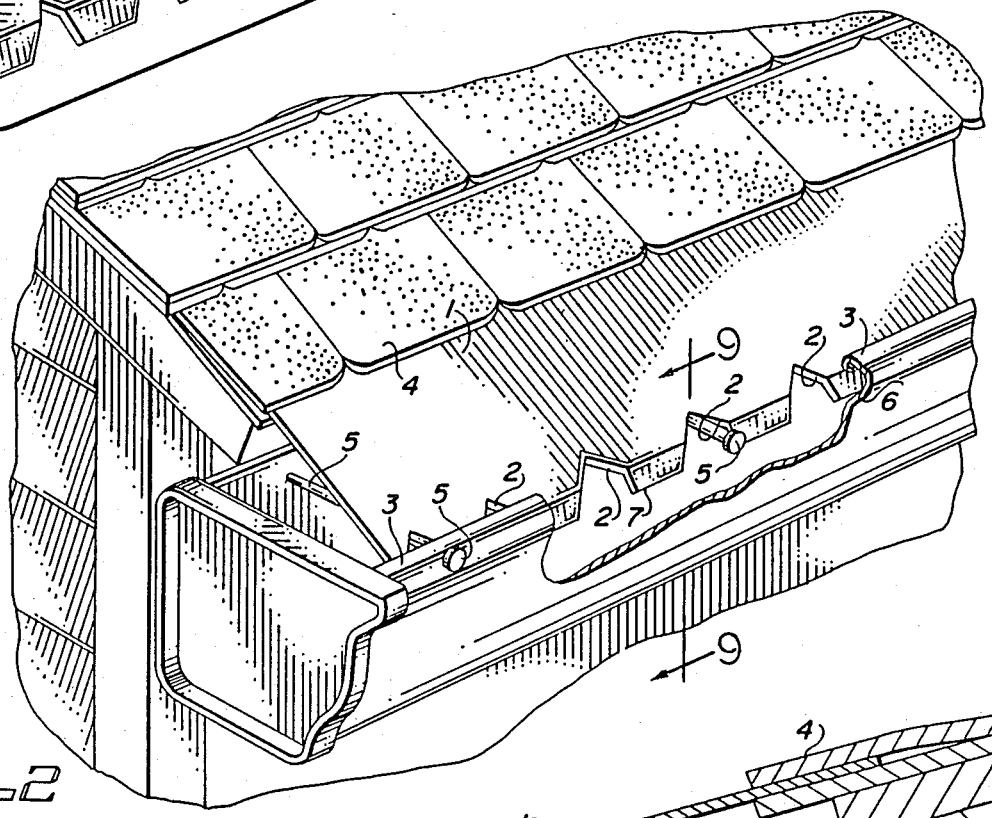
FIG. 2 is a perspective view of the subject gutter guard installed in a conventional gutter system on a building structure.

FIG. 2 Shows how the gutter guard 1 is installed, simply by inserting it under the roof shingles 4 and pulling it snugly against the top lip of the gutter 3, and resting and supported on the gutter inner shelf 6. It shows how the notched edge of the guard 2 permits inserting it over the gutter support nails. These nails, along with the gutter inner shelf 6 provide support for the guard to hold it snugly against the top lip of the gutter 3. The small exposed openings 2 in the guard in the front of the top lip of the gutter 3 permit water to flow into the gutter while excluding pine straw, leaves and other debris.

Figure 3:
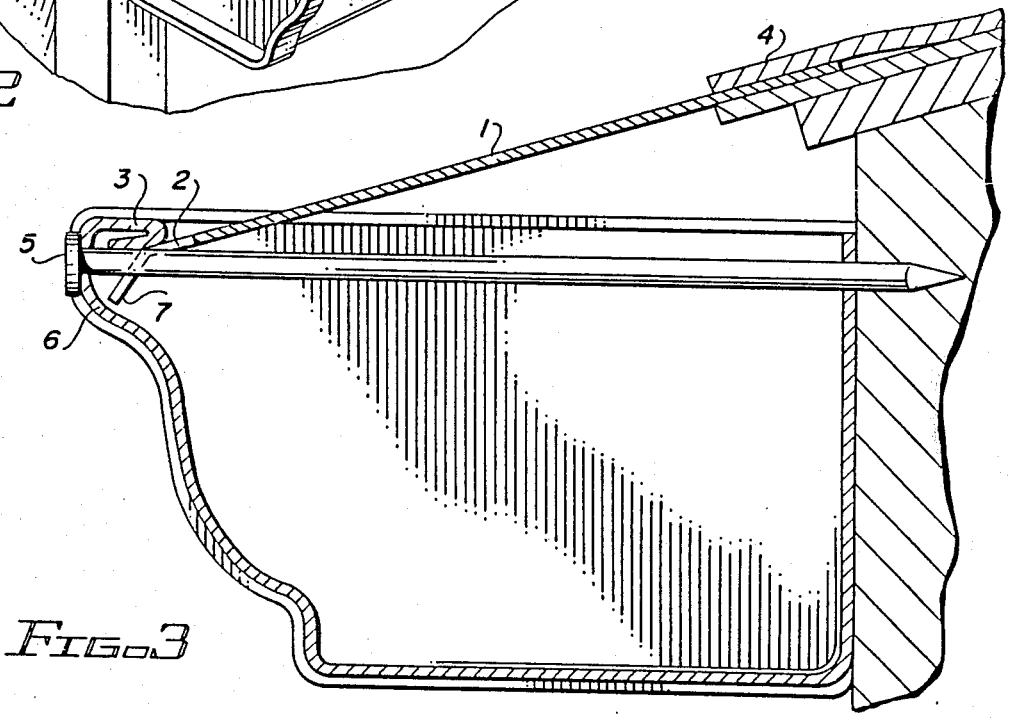
FIG. 3 is a vertical cross-sectional view of the structure of FIG. 2 taken along the line 9—9 thereof.

FIG. 3 is a cross sectional view 9—9 of FIG. 2 of the guard 1, showing how it fits under the roof shingles 4 and how the notch 2 straddles the gutter support nail 5, and how the turned down edge 7 rests on the inner shelf of the gutter 6, thereby supporting the shield and keeping it snug against the top lip of the gutter 3. This top lip 3 thereby constitutes a dam which holds back the rain water as it runs off of the roof shingles 4, so as to divert it through the notches 2 into the gutter. The sharply turned down edge 7 also gives greater longitudinal rigidity to the guard to keep it snug against the gutter lip 3 in the span between the gutter support nails.

I claim:

1. A gutter system comprising in combination a conventional gutter having a predetermined width, an upper inwardly directed top lip, and means to secure said gutter to a building, said combination further comprising:

a gutter shield formed from a length of deformable semi-rigid metallic or plastic strip material dimensioned to span said predetermined width and having first and second sides, said shield having a first planar edge on said first side adapted to permit insertion beneath a row of shingles on a roof and a second notched edge on said second side being bent downward at a sharp angle from the plane of said first edge at a location a short distance from said second side to fit snugly against said inwardly directed lip of said gutter with the second notched edge resting against the inside of the gutter below the said inwardly directed lip, thereby permitting water to enter said gutter while excluding leaves and other debris therefrom.

* * * * *